US009949335B2

(12) United States Patent
Jang

(10) Patent No.: US 9,949,335 B2
(45) Date of Patent: Apr. 17, 2018

(54) METHOD OF MANUFACTURING DISPLAY APPARATUS

(71) Applicant: SAMSUNG DISPLAY CO., LTD., Yongin, Gyeonggi-Do (KR)

(72) Inventor: Joonyung Jang, Yongin (KR)

(73) Assignee: SAMSUNG DISPLAY CO., LTD., Yongin, Gyeonggi-do (KR)

( * ) Notice: Subject to any disclaimer, the term of this patent is extended or adjusted under 35 U.S.C. 154(b) by 46 days.

(21) Appl. No.: 14/593,152

(22) Filed: Jan. 9, 2015

(65) Prior Publication Data

US 2016/0044762 A1 Feb. 11, 2016

(30) Foreign Application Priority Data

Aug. 6, 2014 (KR) ..... 10-2014-0101097

(51) Int. Cl.
*H05B 33/10* (2006.01)
*H05B 33/12* (2006.01)
*H05B 33/04* (2006.01)

(52) U.S. Cl.
CPC ..... *H05B 33/10* (2013.01); *H05B 33/04* (2013.01); *H05B 33/12* (2013.01)

(58) Field of Classification Search
CPC ..... B23K 26/206; C03C 8/24; H01L 51/5246; H05B 33/04; H05B 33/10; H05B 33/12
See application file for complete search history.

(56) References Cited

U.S. PATENT DOCUMENTS

2009/0233513 A1 9/2009 Lee et al.
2010/0075563 A1* 3/2010 Matsui ..... H01L 51/5237 445/25
2011/0091668 A1 4/2011 Lamberson et al.
2011/0209813 A1* 9/2011 Shibuya ..... C03C 8/14 156/89.12

FOREIGN PATENT DOCUMENTS

JP 2009-224092 A 10/2009
KR 10-2002-0016494 A 3/2002
KR 10-2010-0009319 A 1/2010

OTHER PUBLICATIONS

Peter Ramm et al., "Handbook of Wafer Bonding", Wiley-VCH 2012, Verlag C.H. Beck im Internet: www.beck.de, ISBN 978 3 527 32646 4, pp. 1-17.

* cited by examiner

*Primary Examiner* — Nimeshkumar Patel
*Assistant Examiner* — Jacob R Stern
(74) *Attorney, Agent, or Firm* — Lee & Morse, P.C.

(57) ABSTRACT

Provided is a method of manufacturing a display apparatus, including forming a display unit on a first substrate; applying a fit on an encapsulating substrate; melting at least a portion of the frit on the encapsulating substrate; arranging and bonding the first substrate and the encapsulating substrate after melting at least a portion of the frit on the encapsulating substrate, so that the frit is disposed between the first substrate and the encapsulating substrate; and completely melting the frit between the first substrate and the encapsulating substrate.

8 Claims, 5 Drawing Sheets

METHOD OF MANUFACTURING DISPLAY APPARATUS

CROSS-REFERENCE TO RELATED APPLICATION

Korean Patent Application No. 10-2014-0101097, filed on Aug. 6, 2014, in the Korean Intellectual Property Office, and entitled: "Method of Manufacturing Display Apparatus," is incorporated by reference herein in its entirety.

BACKGROUND

One or more embodiments relate to a method of manufacturing a display apparatus, for example, to a method of manufacturing a display apparatus in which a substrate may be effectively prevented from being deformed.

SUMMARY

Embodiments may be realized by providing a method of manufacturing a display apparatus, including forming a display unit on a first substrate; applying a frit on an encapsulating substrate; melting at least a portion of the fit on the encapsulating substrate; arranging and bonding the first substrate and the encapsulating substrate after melting at least a portion of the frit on the encapsulating substrate, so that the fit is disposed between the first substrate and the encapsulating substrate; and completely melting the frit between the first substrate and the encapsulating substrate.

Melting at least a portion of the frit on the encapsulating substrate may include a heat treatment process.

The method may further include sintering the fit on the encapsulating substrate, before melting at least a portion of the frit on the encapsulating substrate.

Melting at least a portion of the frit on the encapsulating substrate may include a heat treatment process.

Melting at least a portion of the frit on the encapsulating substrate and sintering the frit on the encapsulating substrate may be performed in the same chamber.

Melting at least a portion of the frit on the encapsulating substrate may include irradiating a laser beam.

BRIEF DESCRIPTION OF THE DRAWINGS

Features will become apparent to those of ordinary skill in the art by describing in detail exemplary embodiments with reference to the attached drawings in which.

DETAILED DESCRIPTION

Figure 1:
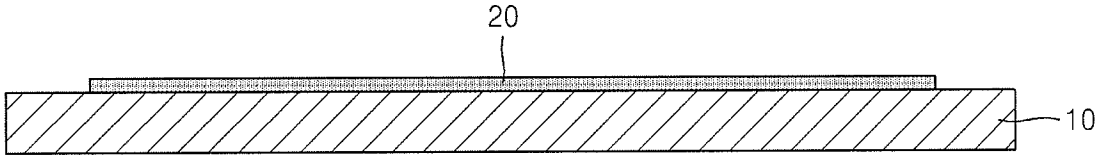
FIGS. 1 to 5 illustrate schematic cross-sectional views of processes of a method of manufacturing a display apparatus, according to an embodiment.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

It will be understood that when a layer, region, or component is referred to as being "formed on," another layer, region, or component, it can be directly or indirectly formed on the other layer, region, or component. That is, for example, intervening layers, regions, or components may be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present.

Sizes of elements in the drawings may be exaggerated for convenience of explanation. In other words, since sizes and thicknesses of components in the drawings are arbitrarily illustrated for convenience of explanation, the following embodiments are not limited thereto.

In the following examples, the x-axis, the y-axis and the z-axis are not limited to three axes of a rectangular coordinate system, and may be interpreted in a broader sense. For example, the x-axis, the y-axis, and the z-axis may be perpendicular to one another, or may represent different directions that are not perpendicular to one another.

FIGS. 1 to 5 illustrate schematic cross-sectional views of processes of a method of manufacturing a display apparatus, according to an embodiment.

The method of manufacturing the display apparatus according to the present embodiment includes preparing a first, e.g., bottom, substrate 10. The bottom substrate 10 may be formed of various materials, for example, glass, metal, or plastic such as polyethylene terephthalate (PET), polyethylene naphthalate (PEN), or polyimide.

After preparing the bottom substrate 10, a display unit is formed on the bottom substrate 10. FIG. 1 illustrates forming a display unit 20, which may include more than one display unit, on the bottom substrate 10. The display unit 20 may include not only the display units, but also a thin film transistor (TFT) or a capacitor that controls operations of the display units. The display units may include various types of display units, for example, organic light-emitting devices.

Figure 2:
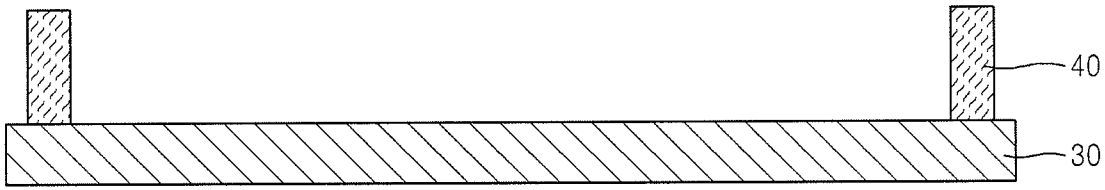

As illustrated in FIG. 2, an encapsulating substrate 30 is prepared. The encapsulating substrate 30 may be formed of various materials, for example, glass, metal, or plastic such as PET, PEN, or polyimide. A frit 40 is applied on the encapsulating substrate 30. When applying the frit 40 on the encapsulating substrate 30, the fit 40 may be applied along, for example, edges of the encapsulating substrate 30 in a form of a closed loop. When applying the frit 40 as described above, the fit 40 may be in a state of paste. The frit 40 in the state of paste may include a binder and a filler which may be a composition of a glass.

Figure 3:
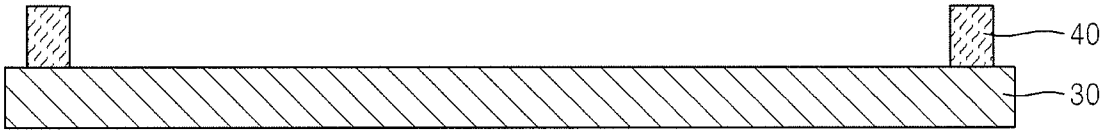
Figure 4:
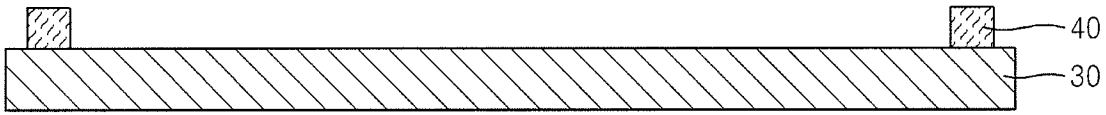

After applying the frit 40 on the encapsulating substrate 30, at least a portion of the frit 40 is melted. Before melting, a drying process and/or a sintering process may be performed if necessary. As illustrated in FIGS. 2 and 3, during the drying process and/or the sintering process, a volume of the frit 40 may be decreased by about 50% compared to a volume thereof before the drying process and/or the sintering process. Thereafter, when at least a portion of the frit 40 is melted, as illustrated in FIGS. 3 and 4, the volume of the frit 40 may be decreased by about 20% to 40% compared to a volume thereof after the drying process and/or the sintering process (in the state shown in FIG. 3).

The process of preparing the bottom substrate 10 and forming the display unit on the bottom substrate 10 and the process of preparing the encapsulating substrate 30, applying the frit 40 on the encapsulating substrate 30, and melting at least a portion of the frit 40 may be performed sequentially in the described order, in an order opposite to the described order, or at the same time. In an embodiment, the process of preparing the bottom substrate 10 and forming the display unit on the bottom substrate 10 and the process of preparing the encapsulating substrate 30 and applying the fit 40 on the encapsulating substrate 30 may be performed sequentially in the described order, in an order opposite to the described order, or at the same time, and then, the process of melting at least a portion of the frit 40 on the encapsulating substrate 30 may be performed. The order of performing the processes may be modified in various ways.

Figure 5:
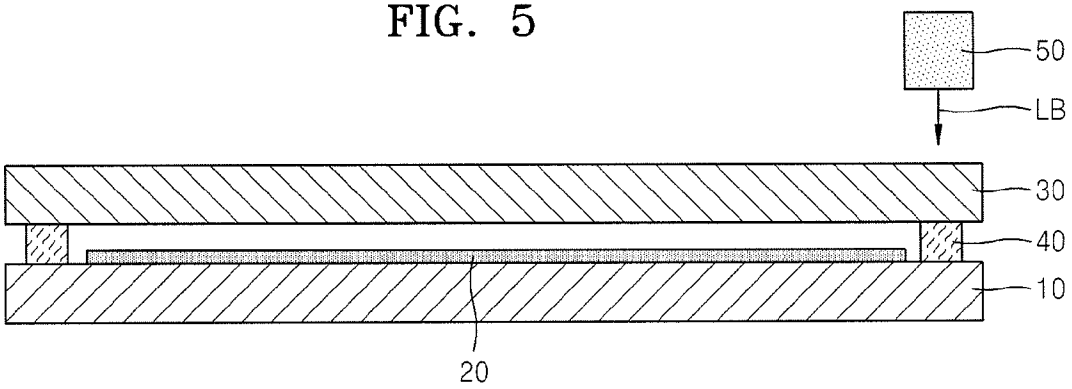

Then, when at least a portion of the frit 40 on the encapsulating substrate 30 is melted, as illustrated in FIG. 5, the bottom substrate 10 and the encapsulating substrate 30 are arranged and bonded such that the frit 40 is disposed between the bottom substrate 10 and the encapsulating substrate 30. Next, a laser source 50 is used to irradiate the frit 40 with a laser beam LB to completely melt the frit 40 between the bottom substrate 10 and the encapsulating substrate 30. When the frit 40 that is completely melted hardens, the frit 40 attaches, and fixes the bottom substrate 10 and the encapsulating substrate 30 to each other.

Based on the method of manufacturing the display apparatus according to the present embodiment, the bottom substrate 10 and the encapsulating substrate 30 are bonded when a change of the volume of the fit 40 is almost finished. The volume change of the fit 40 after the bottom substrate 10 and the encapsulating substrate 30 have been bonded may be minimized, the bottom substrate 10 and the encapsulating substrate 30 may be bonded such that relative locations of the bottom substrate 10 and the encapsulating substrate 30 may be maintained accurately, and a quality of a manufactured display apparatus may be significantly increased.

Figure 6:
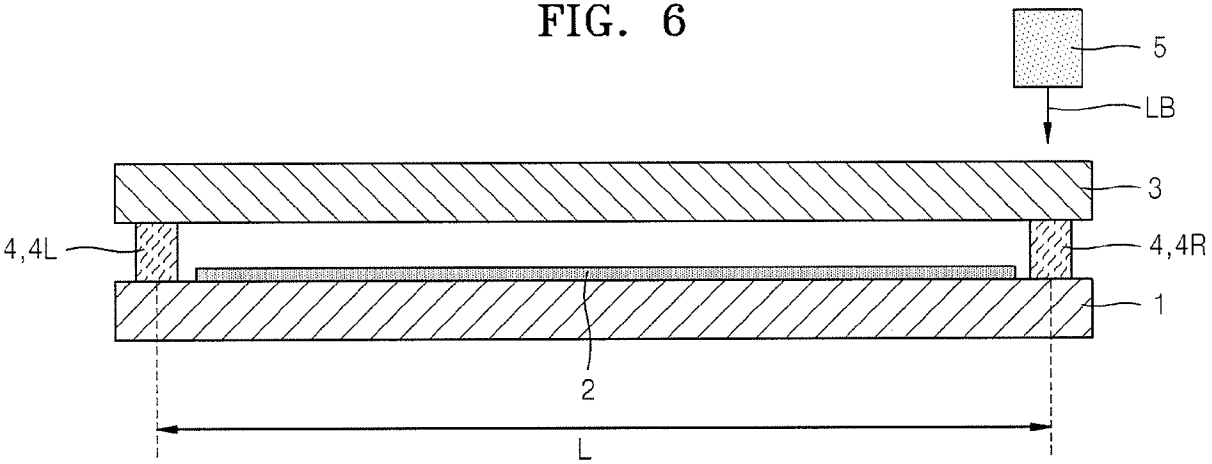
FIGS. 6 to 9 illustrate schematic cross-sectional views and a plan view of processes of a method of manufacturing a display apparatus, according to a comparative example.
Figure 7:
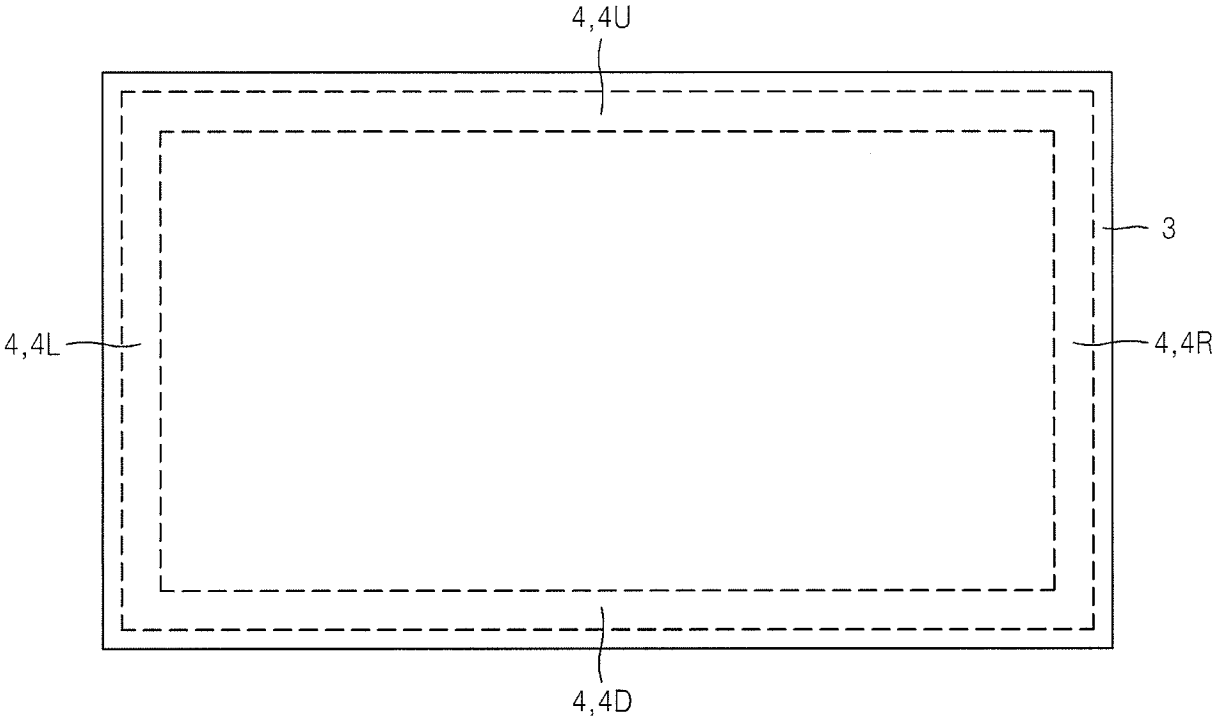

FIGS. 6 to 9 illustrate schematic cross-sectional views and a plan view of processes of a method of manufacturing a display apparatus, according to a comparative example. As illustrated in FIG. 6, based on the method of manufacturing the display apparatus according to the comparative example, when a frit 4 on an encapsulating substrate 3 is not melted but only dried and/or sintered, a display unit 2 that includes display units and the frit 4 are arranged such that they are disposed between a bottom substrate 1 and the encapsulating substrate 3, and then, the bottom substrate 1 and the encapsulating substrate 3 are bonded. As illustrated in FIG. 7, the fit 4 may surround the display unit 2. As further illustrated in FIG. 7 that is a plan view, having the display unit 2 in the center, a right portion of the frit 4 may be referred to as a right frit 4R, a left portion thereof may be referred to as a left frit 4L, an upper portion thereof may be referred to as an upper frit 4U, and a lower portion may be referred to as a lower frit 4D. A center distance between the left and right frits 4L and 4R may be indicated by "L" as shown in FIG. 6. The center distance L may be understood as a distance measured between the left and right frits 4L and 4R on the bottom substrate 1.

Figure 8:
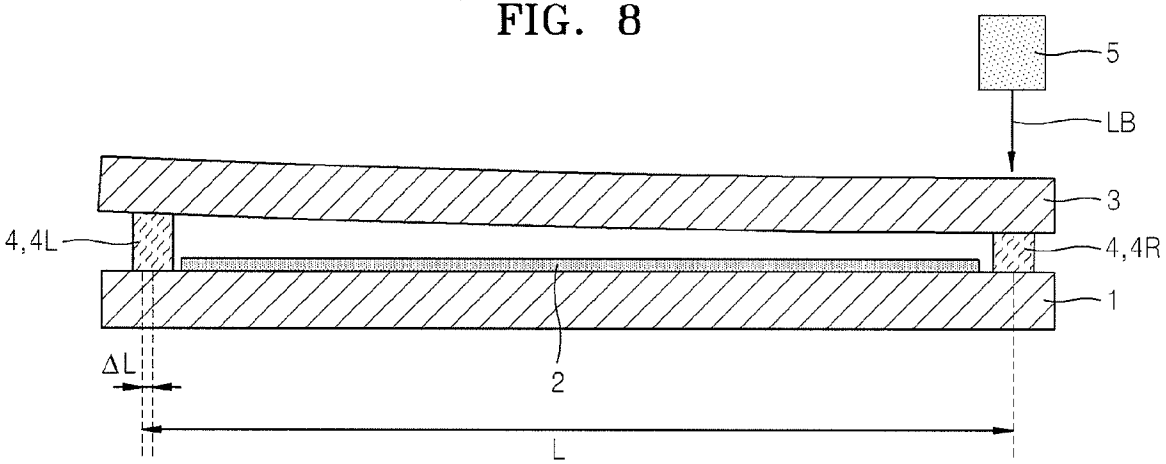

In the above-described state, the bottom substrate 1 and the encapsulating substrate 3 are bonded, and a laser source 5 is used to irradiate the frit 4 with the laser beam LB to melt the frit 4, as illustrated in FIG. 8. A portion of the frit 4 where the laser beam LB is irradiated melts, and, as illustrated in FIG. 8, the right frit 4R may melt but the left frit 4L may not melt, and the upper frit 4U or the lower frit 4D may not melt or only portions that are close to the right frit 4R may melt.

As described above, when the frit 4 changes to a melted state from a dried state and/or a sintered state, a volume of the fit 4 is decreased by about 20% to 40%. A change in a volume causes a change in a height, a volume of the left fit 4L that did not melt is not changed even if a volume of the right frit 4R that has melted is decreased, and the encapsulating substrate 3 may bend due to a height difference between the right and left frits 4R and 4L, as illustrated in FIG. 8. A volume of the encapsulating substrate 3 is constant during this process, and a location of the frit 4, which is fixed to the encapsulating substrate 3, is changed in relation with the bottom substrate 1. The volume of the right frit 4R may be decreased while a location of the right frit 4R that has melted is fixed on the bottom substrate 1, and the left fit 4L may be moved toward the right fit 4R by ΔL on the bottom substrate 1.

Figure 9:
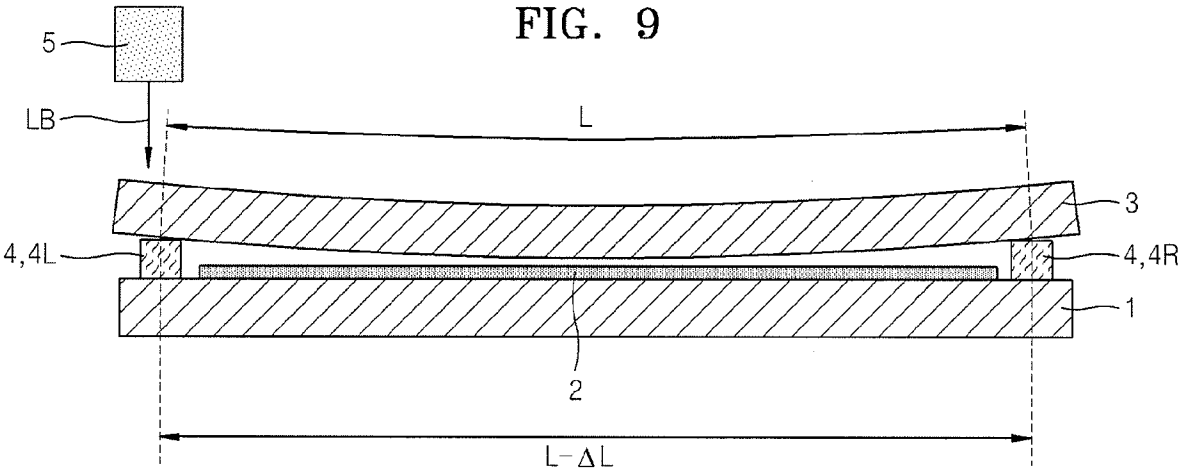

When the left frit 4L is then melted with the laser beam LB, a volume of the left frit 4L is decreased, and respective heights of the left and right frits 4L and 4R become approximately the same, as illustrated in FIG. 9. However, the left frit 4L on the bottom substrate 1 does not remain at the location shown first in FIG. 6, but moves from said location toward the right frit 4R by ΔL, as shown in FIGS. 8 and 9, and a distance between the left and right frits 4L and 4R on the bottom substrate 1 is equal to L-ΔL when the bottom substrate 1 and the encapsulating substrate 3 are completely attached. A distance between the left and right frits 4L and 4R on the encapsulating substrate 3 is still equal to L, and a central portion of the encapsulating substrate 3 may be concave toward the bottom substrate 1, as illustrated in FIG. 9.

Based on the method of manufacturing the display apparatus according to the comparative example, a distance between the bottom substrate 1 and the encapsulating substrate 3 is not maintained at a constant level, and the distance therebetween is different according to locations. As a result, Newton's rings may occur due to interference of light in the bottom substrate 1 and the encapsulating substrate 3, and users' visibility may be decreased. As illustrated in FIG. 9, the encapsulating substrate 3 and the bottom substrate 1 are attached while the central portion of the encapsulating substrate 3 is concave toward the bottom substrate 1, stress may be applied to the encapsulating substrate 3 and/or the bottom substrate 1, and an adhesion strength between the encapsulating substrate 3 and the bottom substrate 1 may be decreased or the encapsulating substrate 3 and/or the bottom substrate 1 may be damaged by external shock.

Based on the method of manufacturing the display apparatus according to the present embodiment, the encapsulating substrate 30 and the bottom substrate 10 are bonded after drying and/or sintering the frit 40 on the encapsulating substrate 30 and then melting at least a portion of the frit 40, the encapsulating substrate 30 and the bottom substrate 10 are bonded when a change of the volume of the frit 40 on the encapsulating substrate 30 is almost finished, and there is almost no change in the volume of the frit 40 in the following processes. The encapsulating substrate 30 may not be deformed while attaching the encapsulating substrate 30 and the bottom substrate 10, and it may be possible to consistently maintain the distance between the encapsulating substrate 30 and the bottom substrate 10 after the attaching process. An optical phenomenon such as Newton's rings may be prevented from occurring in a display apparatus that is manufactured by using the method according to the present embodiment, and visibility of a displayed image may be improved and the adhesion strength between the encapsulating substrate 30 and the bottom substrate 10 may be increased.

A process of melting at least a portion of the frit 40 that is sintered as shown in FIG. 3 so that a volume of the frit 40 is almost completely changed as shown in FIG. 4 may include performing, for example, a heat treatment process. A heat treatment process may also be performed to sinter the frit 40 into a state shown in FIG. 3 after applying the frit 40 on the encapsulating substrate 30 as illustrated in FIG. 2. A heat treatment process for sintering the frit 40 on the encapsulating substrate 30 and a heat treatment process for melting at least a portion of the frit 40 that is sintered may be performed at the same time or in a sequential order, and the heat treatment process for sintering the frit 40 on the encapsulating substrate 30 and the heat treatment process for melting at least a portion of the frit 40 that is sintered may be performed in the same chamber. Additional equipment for melting at least a portion of the frit 40 may not be necessary, and a high quality display apparatus may be manufactured without a substantial increase in the manufacturing cost. A temperature when performing the heat treatment process for melting at least a portion of the frit 40 that is sintered may be higher than a temperature when performing a heat treatment process for drying and/or sintering the frit 40 after the frit 40 is applied on the encapsulating substrate 30. For example, a heat treatment process for drying the fit 40 may be performed in about 120° C., a heat treatment process for sintering the fit 40 may be performed in about 360° C., and a heat treatment process for melting at least a portion of the frit 40 may be performed in about 450° C.

Various methods for performing the process of melting at least a portion of the frit 40 that is sintered, for example, irradiating a laser beam onto the fit 40, may be used. For example, since the heat treatment process needs to be performed at a temperature near or higher than a melting point of the frit 40 so that at least a portion of the frit 40 melts, the encapsulating substrate 30 may be deformed and deteriorated during the heat treatment process. Therefore, the laser beam LB, which may be used to apply energy only on the fit 40 and partially melt the fit 40, may be used.

An example in which the display unit 20 is formed as a single display unit on the bottom substrate 10 has been described. In an embodiment, the display unit 20 may be formed as a plurality of display units on the bottom substrate 10, and the frit 40 may be applied on the encapsulating substrate 30 such that the frit 40 is formed as a plurality of separate closed loops that correspond to the plurality of display units. When at least a portion of the frit 40 is melted, the bottom substrate 10 and the encapsulating substrate 30 may be bonded. Each of the plurality of display units may be surrounded by the fit 40. After the frit 40 is completely melted to attach the bottom substrate 10 and the encapsulating substrate 30, the bottom substrate 10 and the encapsulating substrate 30 are cut, and a plurality of display apparatuses may be simultaneously manufactured.

For example, even when simultaneously manufacturing the plurality of display apparatuses as described above, if a bottom substrate and an encapsulating substrate are bonded and then a fit is sequentially melted to attach the bottom substrate and the encapsulating substrate without melting at least a portion of the frit, each display apparatus may have a shape as illustrated in FIG. 9, in which a central portion of the encapsulating substrate 3 is concave toward the bottom substrate 1 or convex in a direction away from the bottom substrate 1. If the method of manufacturing the display apparatus according to the present embodiment is used, even when simultaneously manufacturing the plurality of the display apparatuses, the space between the bottom substrate 10 and the encapsulating substrate 30 may be maintained in uniform.

By way of summation and review, a display apparatus may have a structure in which a display unit is disposed between two substrates. Thicknesses of substrates may be reduced to manufacture slim display apparatuses, and distances between the substrates may also be reduced. If distances the substrates are not maintained at a constant level, optical interference may occur in the display apparatuses, and users' visibility may be decreased.

As described above, one or more of the above embodiments provides a method of manufacturing the display apparatus in which a substrate may be effectively prevented from being deformed.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A method of manufacturing a display apparatus, comprising: forming a display unit on a first substrate; applying a frit having a first volume on an encapsulating substrate; sintering the frit on the encapsulating substrate at a first temperature such that the first volume of the frit is changed to a second volume that is about 50% of the first volume; melting at least a portion of the frit that has been sintered on the encapsulating substrate such that the second volume of the frit is changed to a third volume that is about 60% to 80% of the second volume at a second temperature which is higher than the first temperature; arranging and bonding the first substrate and the encapsulating substrate after melting at least a portion of the frit on the encapsulating substrate, so that the frit is disposed between the first substrate and the encapsulating substrate; and completely melting the frit between the first substrate and the encapsulating substrate.

2. The method as claimed in claim 1, wherein melting at least a portion of the frit on the encapsulating substrate includes a heat treatment process.

3. The method as claimed in claim 1, wherein melting at least a portion of the frit on the encapsulating substrate includes a heat treatment process.

4. The method as claimed in claim 3, wherein melting at least a portion of the frit on the encapsulating substrate and sintering the frit on the encapsulating substrate are performed in a same chamber.

5. The method as claimed in claim 1, wherein melting at least a portion of the frit on the encapsulating substrate includes irradiating a laser beam.

6. A method of manufacturing a display apparatus, comprising: forming a display unit on a first substrate; applying a frit having a first volume on an encapsulating substrate; sintering the frit on the encapsulating substrate at a first temperature such that the first volume of the frit is changed to a second volume that is about 50% of the first volume; melting at least a portion of the frit that has been sintered on the encapsulating substrate such that the second volume of the frit is changed to a third volume that is about 60% to 80% of the second volume, including a heat treatment process performed at about 450° C. which is higher than the first temperature; arranging and bonding the first substrate and the encapsulating substrate after melting at least a portion of the frit on the encapsulating substrate, so that the frit is disposed between the first substrate and the encapsulating substrate; and completely melting the frit between the first substrate and the encapsulating substrate.

7. The method as claimed in claim 6, wherein the first temperature is about 360° C.

8. The method as claimed in claim 7, further comprising, before sintering the frit on the encapsulating substrate, drying the frit on the encapsulating substrate, wherein drying the frit on the encapsulating substrate is performed at about 120° C.

* * * * *